US006309464B1

(12) United States Patent
Anfindsen

(10) Patent No.: US 6,309,464 B1
(45) Date of Patent: Oct. 30, 2001

(54) PLANT FOR FEEDING PAINT TO A SPRAY APPLICATION APPARATUS

(75) Inventor: Ole Arnt Anfindsen, Sandnes (NO)

(73) Assignee: ABB Flexible Automation AS, Bryne (NO)

( * ) Notice: Subject to any disclaimer, the term of this patent is extended or adjusted under 35 U.S.C. 154(b) by 0 days.

(21) Appl. No.: 09/403,976

(22) PCT Filed: May 4, 1998

(86) PCT No.: PCT/IB98/00667

§ 371 Date: Jan. 21, 2000

§ 102(e) Date: Jan. 21, 2000

(87) PCT Pub. No.: WO98/51415

PCT Pub. Date: Nov. 19, 1998

(30) Foreign Application Priority Data

May 9, 1997 (SE) ..... 9701745

(51) Int. Cl.[7] ..... B05C 11/00
(52) U.S. Cl. ..... 118/668; 118/708; 118/323
(58) Field of Search ..... 118/668, 708, 118/300, 326, 302, 323

(56) References Cited

U.S. PATENT DOCUMENTS

| | | | | |
|---|---|---|---|---|
| 3,673,967 | * | 7/1972 | Kropf | 104/88 |
| 4,630,567 | * | 12/1986 | Bambousek et al. | 118/323 |
| 4,785,760 | | 11/1988 | Tholome . | |
| 5,293,911 | | 3/1994 | Akeel . | |
| 6,071,346 | * | 6/2000 | Yamauchi et al. | 118/668 |

FOREIGN PATENT DOCUMENTS

WO 97/00731 1/1997 (WO) .

* cited by examiner

*Primary Examiner*—Richard Crispino
*Assistant Examiner*—Yewebdar T Tadesse
(74) *Attorney, Agent, or Firm*—Connolly Bove Lodge & Hutz, LLP

(57) ABSTRACT

A plant is adapted to feed paint to robots for automatic spray application of paint on objects provided with a container (5) made loosenable and removable from the robot for exchange for another such container when there is a desire to have more paint in the container and/or change paint. The plant has a station (8) with containers filled with paint, a transport device (15–18) with means (16) for transporting a container containing paint from said station when said desire arises to the robot and deliver this thereto as well as means adapted to receive a container to be exchanged from the robot and transport it away for taking care thereof.

17 Claims, 3 Drawing Sheets

PLANT FOR FEEDING PAINT TO A SPRAY APPLICATION APPARATUS

REFERENCE TO RELATED APPLICATION

This Application is a 371 of PCT/IB98/00667, filed May 4, 1998, based on Sweden 9701745-3, Filed May 9, 1997.

FIELD OF THE INVENTION AND PRIOR ART

The present invention relates to a plant for feeding paint to at least one apparatus having a nozzle and being adapted for automatic spray application of paint on objects, said plant having a unit providing paint arranged to be connected to the nozzle during the application for providing it with paint as well as an arrangement coordinated with said unit for enabling change of paint and/or filling of paint in the unit connected to the spray nozzle.

Such a plant may be arranged to provide different types of spray application apparatuses with paint within a number of different fields of use, but for illuminating, but not in any way restricting the invention, the use of such a plant for feeding paint to one or more spray application robots for painting objects, such as vehicle bodies, will hereinafter mainly be discussed, but the invention comprises also supply of paint to such apparatuses in the form of so called painting machines. "Paint" is here to be given a broad sense and comprises all types of paints and lacquer suited for spray application.

Plants of this type already known have a number of units providing paint in the form of paint sources located centrally at a distance from the spray robot, one for each paint type and colour, which are connected to the spray nozzle through a ring circuit each. Furthermore, a selection of paint is made locally on the apparatus in question, so that a great amount of valves, easy in the order of 60, have to be arranged on the spray robot. This means several considerable disadvantages, primarily when the amount of possible paint types and colours to be sprayed by the spray robot is increasing. At a greater such amount a great amount of hoses running to and from the spray robot are required, both generating high costs and restricting the ability to move of the spray robot. Moreover, it means that a great amount of hoses are to be kept clean and free from plugging. Furthermore, as already mentioned, a large number of valves and control members for controlling the latters is at the same time needed.

Another disadvantage arises when the paints are water born, which are more and more used, since these paints have a higher viscosity than paints on oil base, so that a higher pump pressure is required for pumping the paint in the spray robot and the risk for depositing and plugging of hoses is also increased. Furthermore, a considerable problem to obtain electrical insulation between the paint sources and the spray nozzle also arises in electrostatic painting while using water born paints and said ring conduits.

SUMMARY OF THE INVENTION

The object of the present invention is to provide a plant of the type defined in the introduction, which to a large extent finds a remedy to the inconveniences mentioned above of already known such plants.

This object is obtained according to the invention by providing a plant, in which said unit providing paint is formed by a paint container adapted to be arranged on said apparatus close to the spray nozzle, the container is made loosenable and removable from the apparatus for exchange for another such container when there is a desire of more paint in the container and/or change of paint, and the arrangement comprises a station having containers filled with paint and being remotely located with respect to the apparatus, a transport device having means for transporting a container containing paint from said station to said apparatus when said desire arises and give it to the apparatus as well as means adapted to receive a container to be exchanged from the apparatus and transport it away for taking care thereof.

Thus, the invention is based on the idea of moving said unit providing paint all the way to the very spray application apparatus, so that the connection thereof to the spray nozzle during the application will be short, and to replace the units containing paint located at a large distance to the spray application apparatus and the ring conduits running therefrom to the spray application apparatus by a station with containers filled with paint and a transport device for transporting the containers to and away from the spray application apparatus Long ring conduits, which may be plugged and which require a comparatively high pump power, especially when pumping water born paints of a high viscosity, are hereby avoided. The spray application apparatus will neither be burdened by a great amount of hoses and valves, thanks to the centralized paint selection made possible here in said station and not at the spray application apparatus. There is neither any insulating problem when using water born paints in connection with electrostatic painting. Other advantages of a plant of this type are that it requires a smaller volume in the factory or the like in which it is arranged, and it increases the flexibility for rebuilding and modifications in the production. The loss of paint will also be smaller than in the plants already known.

According to another preferred embodiment of the invention the plant comprises a control device adapted to effect exchange of containers through control units included therein according to wishes expressed by information concerning point of time for container exchange and type and colour of paint to be brought in a container to said apparatus. It may be ensured through such a control device that the spray application apparatus all the time receives exactly the paint required thereby at every point of the time for painting a particular object in a predetermined way.

According to another preferred embodiment of the invention the control device comprises a first control unit for controlling the transport device, a second control unit for controlling paint handling members included in said station and a third control unit for controlling said at least one spray application apparatus, and the control device comprises a communication network interconnecting said control units and members for coordinating the controls through the different control units so as to obtain said exchange of containers desired. The spray application apparatus may be provided with exactly the paint it shall have in every given instant while avoiding all the disadvantages discussed above of the plants already known by arranging such control units and interconnecting them through a communication network.

According to another preferred embodiment of the invention said station has a supply of paints of different types and/or colours, it has also paint handling members in the form of members for filling empty containers with paint, and the second control unit is arranged to control the filling members according to data introduced into the control device and relating to future container exchanges. Conduits required may be made considerably shorter thanks to the centralized colour selection obtained in this way, so that the pumps required are consuming considerably less power and a lower pressure fall is required, and it will also be easier to remove depositings in the conduits.

The conduits may here be made very short instead of the long ring conduits to the spray application apparatus in the plants already known.

According to another preferred embodiment of the invention the transport device comprises a transport track running in a loop from said station to the region of said apparatus and back to the station for transporting said containers, and said means for transporting containers to and away from the apparatus comprises carriages having members for receiving containers and members for driving these to move along the transport track. A change of paint type and/or colour or filling of paint in said apparatus may easily take place thanks to the arrangement of such carriages for container transport.

According to another preferred embodiment of the invention each carriage has at least two said receiving members, a first one intended to be provided with a container during the movement of the carriage from the station to the apparatus and empty during the movement of the carriage from the apparatus to the station and a second one adapted to be empty during the movement of the carriage from the station to the apparatus and have an exchanged container delivered by the apparatus received therein during the movement of the carriage from the apparatus to the station. A carriage may by designing it in this way both transport a container to the spray application apparatus and when returning to the station carry the container exchanged therealong, at the same time as the exchange of containers in the apparatus will be simple, since the second receiving member is free when the carriage arrives to the apparatus, so that the apparatus may first of all deliver the container to be exchanged to the carriage and then without any problem fetch the new container from the carriage.

According to another preferred embodiment of the invention the plant is adapted to feed paint to a plurality of said spray application apparatuses, and the transport track has a plurality of loops for feeding spray application apparatuses arranged in parallel. A greater amount of spray application apparatuses may in this way be provided with a desired paint emanating from a station. It is then advantageous that the transport track has a joint loop part for transport of containers to and away from the different spray application apparatuses and parallel outer loops connected thereto and running to separate spray application apparatuses. The construction of the plant is hereby simplified and the cost counted per spray application apparatus is hereby reduced. In the particular case of painting vehicle bodies through spray robots the plant may hereby by simple means provide a number of working stations in the form of spray booths, which each contains several spray robots, with the paint to be applied on the vehicle body located in each individual spray booth in a given instant.

Further advantages and preferred features of the invention appear from the following description as well as the other dependent claims.

BRIEF DESCRIPTION OF THE DRAWINGS

With reference to the appended drawings, below follows a description of a preferred embodiment of the invention cited as an example In the drawings.

DETAILED DESCRIPTION OF A PREFERRED EMBODIMENT OF THE INVENTION

Figure 1:
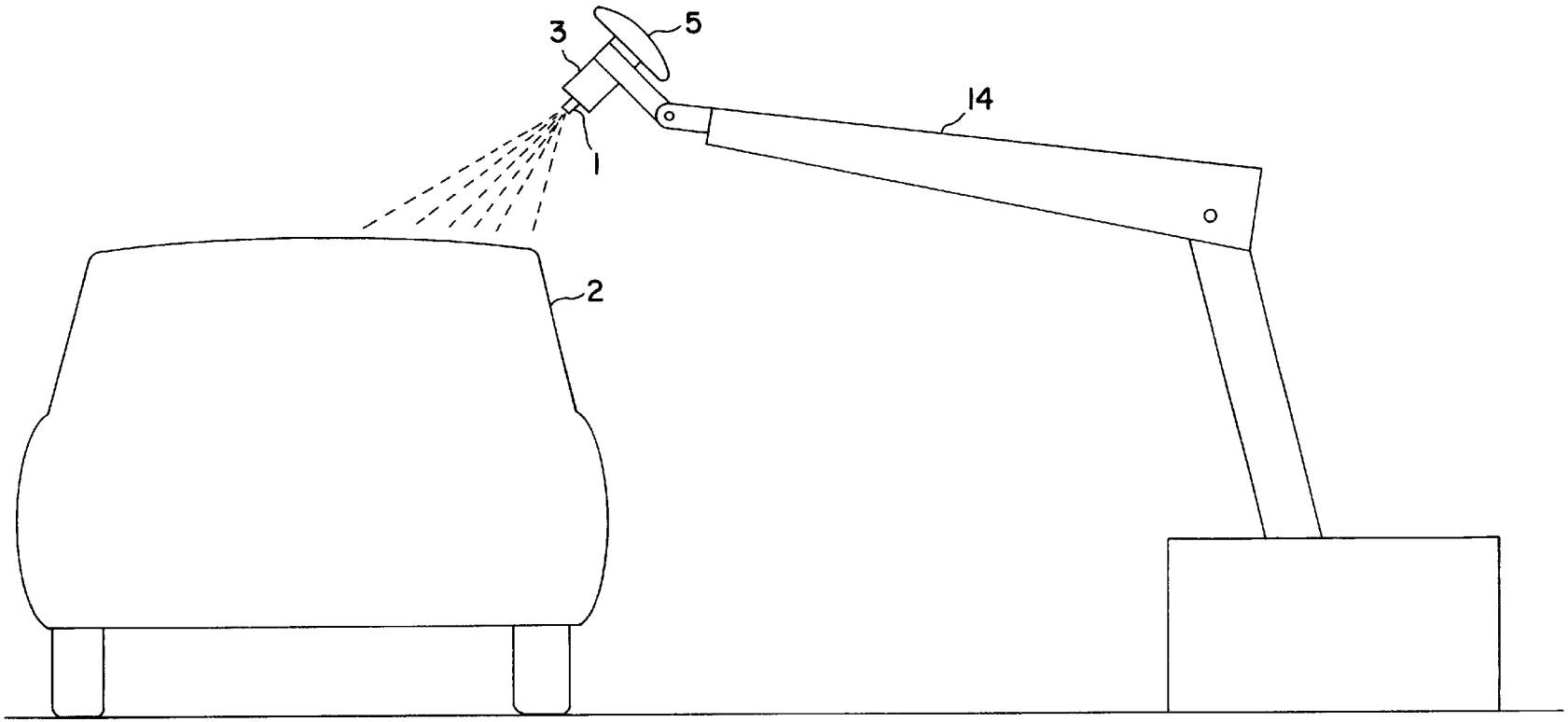
FIG. 1 is a very schematic view of a robot for spray application of paint on a vehicle body, said robot being provided with a paint container.

An apparatus for spray application of paint in the form of a spray painting robot is very schematically illustrated in FIG. 1, and this is adapted to be used together with a plant for feeding paint thereto according to the invention. This robot has different robot arms hingedly interconnected and a spray nozzle 1 in the form of a gun is arranged outermost on the last robot arm, but there may also be a question of a bell, and this spray nozzle is adapted for spray application of atomized paint on an object 2, here a vehicle body. The spray nozzle is connected to an arrangement 3 schematically indicated for atomizing the paint delivered to the spray nozzle 1 through a conduit from a container 5 containing paint and located in the immediate vicinity of the spray nozzle. Different conduits for example supply of compressed air for electric control of parts including in the apparatus have been omitted in FIG. 1 for the sake of simplicity, and parts thereof having nothing to do with the invention have neither been shown in the other figures.

The construction of a plant according to a preferred embodiment of the invention is schematically illustrated in FIG. 1. This plant is adapted to feed paint to twelve spray robots 14 of the type shown in FIG. 1, which are distributed on three individual spray booths 6 enclosing a spray painting space substantially tightly by the walls thereof. It is schematically illustrated that a conveyor or a similar feeding arrangement 7 runs through the respective booth for transporting a vehicle body therethrough.

The plant has a station 8 located remotely with respect to the spray robot 14 with a paint supply 9 with a plurality of different reservoirs 10 containing paints of different colours and/or types. Local ring conduits 11 for transport of a desired paint to a position 12 for filling paint into containers 5 of the type illustrated in FIG. 1 run from these reservoirs. This filling of paint through said ring conduits is controlled by a second control unit 13, which also controls the other functions in said station 8, which will be explained further on.

The plant comprises also a transport device adapted to transport containers filled with paint from the station 8 to the respective spray robot 14 and containers exchanged from the spray robot back to the station. This transport device has a transport truck 15, which may be for example a railway, on which carriages 16 adapted to transport said containers 5 may move. The transport track has a joint loop part 17 for transport of containers to and away from the spray booths and parallel outer loops 18 connected thereto and running to two spray robots each.

Each carriage 16 has two members 19, 20 for receiving containers, of which a first one 20 is intended to be provided with a container during the movement of the carriage from the station 8 to a spray robot and be empty during the movement of the carriage from the spray robot to the station and a second one 19 is adapted to be empty during the movement of the carriage from the station to the spray robot and have an exchanged container delivered by the latter received therein during the movement of the carriage from the robot to the station.

The station 8 has also members 21, 22 schematically indicated for drainage of paint from the container exchanged should it still contain paint and washing of drained or emptied containers, respectively. However, it would be well possible to use a set of containers for each type and colour of paint, so that no drainage or washing is required, but the container may simply be filled with further paint for being transported to a spray robot later on at a desired point of time. Another alternative consists in having a set of containers for some so called main paints most frequently used and alternating paints in the other containers, in which it is only necessary to draing and wash the latters. A third alternative consists in draining and washing all the containers after use thereof. The containers coming back to the station have certainly a small amount of paint, since the dosing of paint to the containers has taken place with a comparatively high accuracy, but the amount still there may be handled in three different ways. A first consists in discharging the paint to a dump. Another possibility is to discharge it to a local ring conduit for return paints with a small storing system for reuse when the amount collected is sufficiently large, and a discharging is then carried out into the respective reservoir. The third alternative is to drain directly into the local main ring conduit 11 for transport to the respective reservoir.

The station 8 also comprises a space 23 adapted to take care of a buffer storage of empty said containers waiting to be filled with paint in the position 12 following thereupon.

The plant has also a control device with a first control unit 24 for controlling the transport device, the second control unit 13, a third control unit 25 for controlling the spray robots 14 as well as a fourth so called line control unit 26, on which data are introduced concerning which type of paint and paint colour the paint to be sprayed by a certain robot at a given point of time shall have. These data may emanate from an automobile sales location and in principle constitute an order list for cars provided with different paintings. The different control units of the control device are interconnected by a communication network 27, and the control unit 26 preferably co-ordinates the controls through the different control units so as to obtain the container exchanges desired. The control units are preferably computers.

Figure 4:
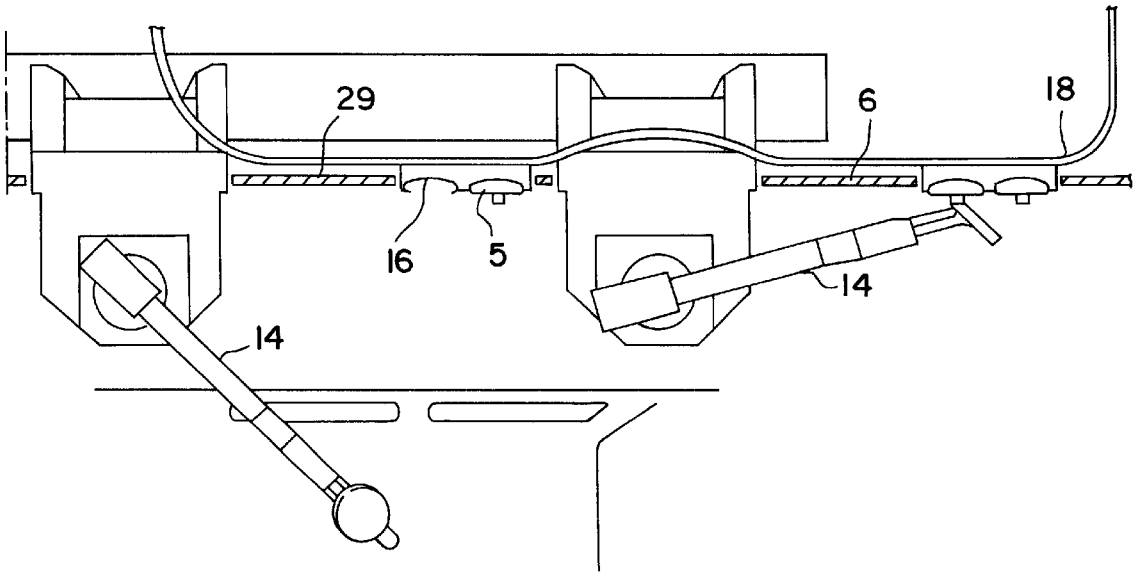
FIG. 4 is an enlarged view from above of a part of the plant shown in FIG. 2 illustrating how an exchange of paint container takes place at the respective spray robot.

The control through the different control units may take place in the following way Each car may have a transponder placed therein, which contains a memory, in which information about model, variant, colour and so on is stored, so that this information may follow the car. Alternatively, this information may be introduced into the line control unit 26. When the car, or more correctly the vehicle body, enters a spray booth 6 the control unit 25 receives said information. The control unit 25 delivers this information to a particular control unit for the respective robot of the spray booth, which has all the programs for the spraying and knows how much paint is consumed during the spraying. The robot control unit delivers this information to the spray booth control unit 25, which calculates the point of time for a new spraying work. Type and colour of paint, amount of paint and point of time for arrival to the respective robot are forwarded through the network 27 to the control unit 13 of the station 8, which effects filling of a desired number of containers with the paint asked for at a given amount and provides the carriage in question with a correct address, either directly in a local carriage computer or through the transport control unit 24. The carriage is then sent on the transport track 15, and the carriage may be driven by for example chains or have driving means of its own with an own motor from an own rechargeable battery. The carriages may be intelligent ones having an own driving unit and an own computer, which may after receiving an address navigate through the different track changes on its own and park in the correct position (see FIG. 4) for container exchange and then return with an "empty" container. It is also possible that the carriage is a so called "stupid" carriage being completely controlled by the control unit 24 which calculates the position of each carriage and controls track changes required (transitions from the joint loop part 17 to a desired outer loop 18).

Figure 2:
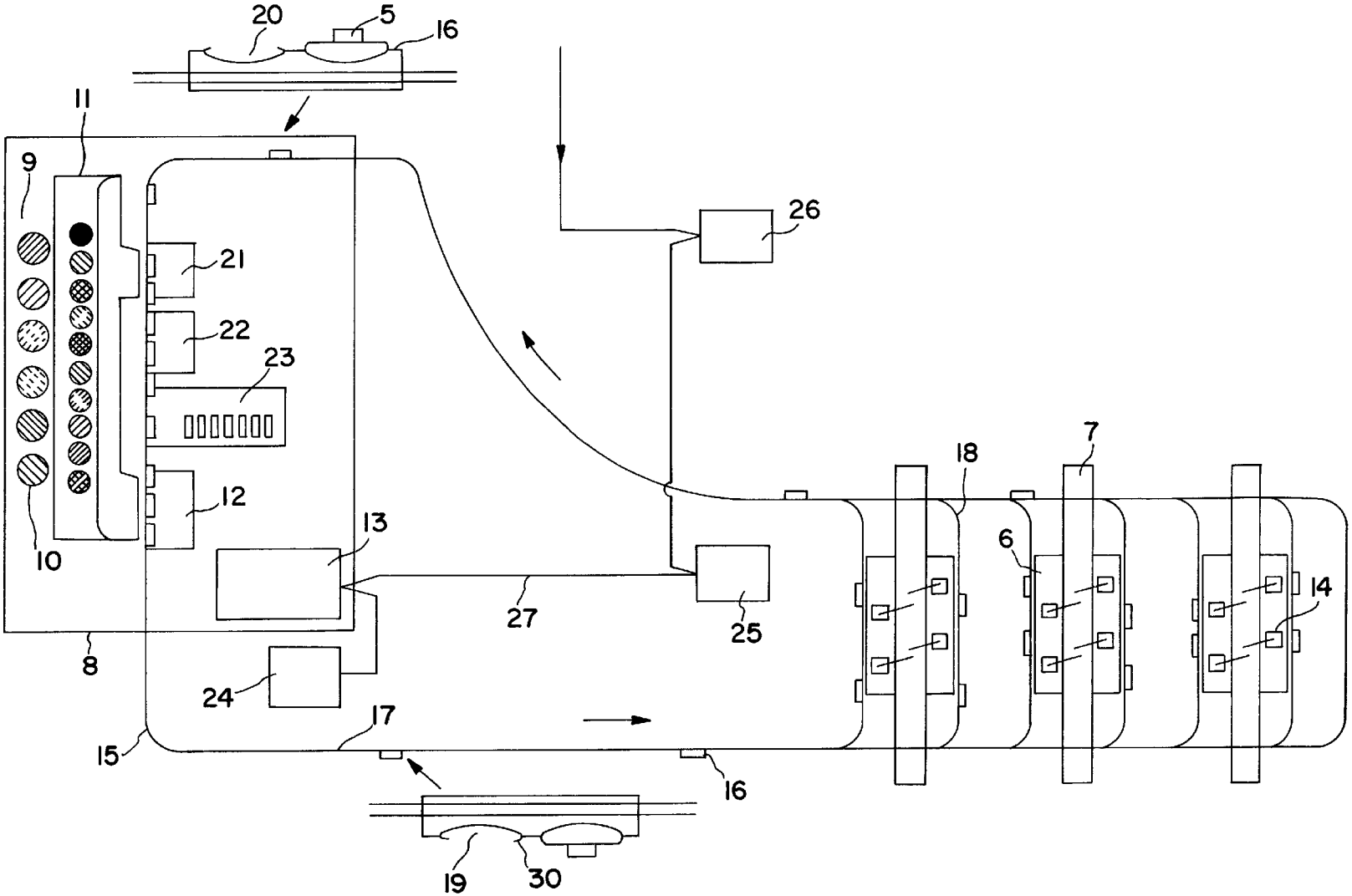
FIG. 2 is a schematic view of a plant according to a preferred embodiment of the invention.
Figure 3:
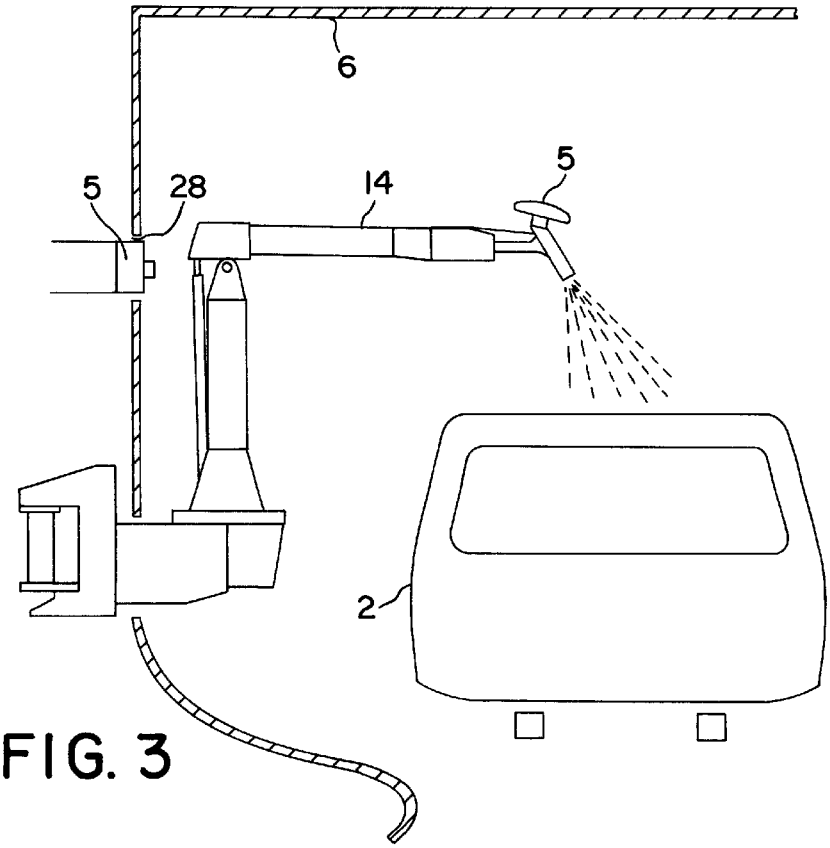
FIG. 3 is an enlarged view of a part of a spray booth having a spray robot adapted to receive paint through the plant illustrated in FIG. 2.

The actual exchange of container takes place in the following way. When a carriage arrives to the spray booth 6 in question it parks right in front of an opening 28 in the wall 29 of the spray booth. The arrival of the carriage is then signalized to the robot which introduces the "empty" container thereof into the empty receiving member 19 of the carriage into gripping members 30 arranged therein and schematically indicated in FIG. 2 and releases the members it has itself for gripping the container, so that this is given to the carriage. The robot is then moving its outer arm so that the manipulator with said members come into a position for gripping the filled container located in the carriage, the robot control unit then signalizes to the carriage that the gripping has taken place, so that the carriage then releases the container. The robot arm then moves away from the carriage and is ready for spraying, while the carriage is ready for moving further back to the station 8 with the empty container.

The invention is of course not in any way restricted to the preferred embodiment described above, but many possibilities to modifications thereof will be apparent to a man skilled in the art without departing from the basic idea of the invention as defined in the claims.

A number of variants have been mentioned above, but it may here be mentioned that it would for example be possible to provide each carriage with more than two containers receiving members, for example four, so that a carriage may provide more than one apparatus with a new container during the same "lap" of the transport track.

The patent claim definition "a first control unit for controlling the transport device" is here to be given a very broad sense and comprises also the case of an arrangement of separate control units for each of the carriages or the like through which the containers are transported.

What is claimed is:

1. A plant for feeding paint to at least one apparatus (14) having a nozzle (1) and being adapted for automatic spray application of paint on objects (2), said plant having a unit providing paint arranged to be connected to the nozzle during the application for providing it with paint as well as an arrangement coordinated with said unit for enabling change of paint and/or filling of paint in the unit connected to the spray nozzle, characterized in that said unit providing paint is formed by a paint container (5) adapted to be arranged on said apparatus close to the spray nozzle, that the container is made loosenable and removable from the apparatus for exchange for another such container when there is a desire of more paint in the container and/or change of paint, and that the arrangement comprises a station (8) having containers filled with paint and being remotely located with respect to the apparatus, a transport device (15–18) having means (16) for transporting a container containing paint from said station to said apparatus when said desire arises and give it to the apparatus as well as means (16) adapted to receive a container to be exchanged from the apparatus and transport it away for taking care thereof.

2. A plant according to claim 1, characterized in that it comprises a control device adapted to effect exchange of containers through control units included therein according to wishes expressed by information concerning point of time for container exchange and type and colour of paint to be brought in a container to said apparatus.

3. A plant according to claim 2, characterized in that the control device comprises a first control unit (24) for controlling the transport device, a second control unit (13) for controlling paint handling members included in said station (8) and a third control unit (25) for controlling said at least one spray application apparatus, and that the control device comprises a communication network (27) interconnecting said control units and members (26) for co-ordinating the controls through the different control units so as to obtain said exchange of containers desired.

4. A plant according to claim 1, characterized in that said station (8) has a supply (9) of paints of different types and/or colours.

5. A plant according to claim 2, characterized in that said station (8) has paint handling members in the form of members for filling empty containers with paint, and that the second control unit (13) is arranged to control the filling members according to data introduced into the control device and relating to future container exchanges.

6. A plant according to claim 5, characterized in that said station (8) has spaces (23) arranged to take care of a buffer storage of empty said containers waiting to be filled with paint through said filling members.

7. A plant according to claim 1, characterized in that said means (16) for transporting an exchanged container away from the apparatus are adapted to transport the container to said station (8), and the station comprises members (21, 22) adapted to carry out a drainage of paint possibly present in the container exchanged and washing of the container.

8. A plant according to claim 1, characterized in that the transport device comprises a transport track (15) running in a loop from said station to the region of said apparatus and back to the station for transporting said containers.

9. A plant according to claim 8, characterized in that said means for transporting containers to and away from the apparatus comprise carriages (16) having members (19, 20) for receiving containers and members for driving these to move along the transport track.

10. A plant according to claim 9, characterized in that each carriage has at least two said receiving members, a first one (20) intended to be provided with a container (5) during the movement of the carriage from the station to the apparatus and empty during the movement of the carriage from the apparatus to the station and a second one (19) adapted to be empty during the movement of the carriage from the station to the apparatus and have an exchanged container delivered by the apparatus received therein during the movement of the carriage from the apparatus to the station.

11. A plant according to claim 9, characterized in that the carriage has holding members (30) adapted to hold a container placed on the carriage on the carriage (16).

12. A plant according to claim 1, said apparatus being arranged inside a spraying booth (6) substantially tightly enclosing a spray painting space by the walls (29) thereof, characterized in that the spray booth has an opening (28) in a wall thereof and the transport device is adapted to transport the containers along a path (18) passing this opening for container exchange in the apparatus through the opening.

13. A plant according to claim 1, characterized in that it is adapted to feed paint to a plurality of said spray application apparatuses (14).

14. A plant according to claim 8, characterized in that the transport track has a plurality of loops (18) so as to feed spray application apparatuses arranged in parallel.

15. A plant according to claim 14, characterized in that the transport track (15) has a joint loop part (17) for transport of containers to and away from the different spray application apparatuses and parallel outer loops (18) connected thereto and running to separate spray application apparatuses.

16. A plant according to claims 1, characterized in that the spray application apparatuses are spray robots.

17. A plant according to claims 1, characterized in that it comprises at least four times as many containers (5) as the number of spray application apparatuses (14) to which it is intended to feed paint to, namely one container arranged in the apparatus, one container for transport to the apparatus for container exchange, one exchanged container under transport away from the apparatus as well as a container arranged in said station (8).

* * * * *